US008615895B2

(12) United States Patent
Shin et al.

(10) Patent No.: US 8,615,895 B2
(45) Date of Patent: Dec. 31, 2013

(54) CLOTHES DRYER

(75) Inventors: Chang Bong Shin, Suwon-si (KR); Jin Wook Yoon, Yongin-si (KR); Sin Ae Kim, Hwaseong-si (KR); Byeong Cheol Yoon, Suwon-si (KR); Seok Mo Chang, Bucheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 471 days.

(21) Appl. No.: 12/932,818

(22) Filed: Mar. 3, 2011

(65) Prior Publication Data

US 2011/0277336 A1 Nov. 17, 2011

(30) Foreign Application Priority Data

May 13, 2010 (KR) ..... 10-2010-0045106

(51) Int. Cl.
*F26B 11/02* (2006.01)

(52) U.S. Cl.
USPC ..... 34/82; 34/606; 34/610; 68/18 R; 8/149.3

(58) Field of Classification Search
USPC ..... 34/82, 86, 83, 130, 595, 601, 606, 610; 68/12.01, 12.03, 5 R, 18 R, 207; 8/137, 8/149.3, 159
See application file for complete search history.

(56) References Cited

U.S. PATENT DOCUMENTS

| | | | | |
|---|---|---|---|---|
| 2,114,776 | A * | 4/1938 | Davis | 68/18 R |
| 3,246,493 | A * | 4/1966 | Oles | 68/18 R |
| 6,691,536 | B2 * | 2/2004 | Severns et al. | 68/12.27 |
| 7,055,262 | B2 * | 6/2006 | Goldberg et al. | 34/86 |
| 7,886,458 | B2 * | 2/2011 | Blair | 34/83 |
| 8,240,064 | B2 * | 8/2012 | Steffens | 34/480 |
| 8,418,377 | B2 * | 4/2013 | Grunert et al. | 34/86 |
| 8,438,750 | B2 * | 5/2013 | Dittmer et al. | 34/83 |
| 2004/0221474 | A1 | 11/2004 | Slutsky et al. | |
| 2005/0126606 | A1 * | 6/2005 | Goedhart et al. | 134/42 |
| 2005/0166420 | A1 * | 8/2005 | Slutsky et al. | 34/312 |
| 2007/0022790 | A1 * | 2/2007 | Slutsky et al. | 68/208 |
| 2009/0151191 | A1 * | 6/2009 | Grunert | 34/480 |
| 2010/0146811 | A1 * | 6/2010 | Steffens | 34/480 |
| 2011/0277336 | A1 * | 11/2011 | Shin et al. | 34/130 |
| 2011/0302967 | A1 * | 12/2011 | Grunert et al. | 68/20 |
| 2012/0017456 | A1 * | 1/2012 | Grunert | 34/82 |
| 2013/0008049 | A1 * | 1/2013 | Patil | 34/469 |

FOREIGN PATENT DOCUMENTS

| | | | | |
|---|---|---|---|---|
| EP | 0 648 885 | | 4/1995 | |
| EP | 789105 | A1 * | 8/1997 | D06F 58/24 |
| EP | 0 816 549 | | 1/1998 | |
| EP | 816548 | A2 * | 1/1998 | D06F 25/00 |
| EP | 2 196 577 | | 6/2010 | |
| WO | 2009/015919 | | 2/2009 | |

* cited by examiner

*Primary Examiner* — Steve M Gravini
(74) *Attorney, Agent, or Firm* — Staas & Halsey LLP

(57) ABSTRACT

A device and method for cleaning a lint filter in a clothes dryer. The clothes dryer includes an air channel connected to a drum to supply air into the drum and to guide air discharged from the drum, a dehumidification unit disposed in the air channel to condense moisture contained in the air discharged from the drum, a waterspout to collect condensed water created by the dehumidification unit, a filter to filter lint from the air discharged from the drum, a cleaning nozzle to spray water to the filter to remove the lint from the filter, a recovery water tank to receive water from the waterspout, and a cleaning water tank connected to the recovery water tank to receive water from the recovery water tank and to supply the water to the cleaning nozzle.

32 Claims, 16 Drawing Sheets

CLOTHES DRYER

CROSS-REFERENCE TO RELATED APPLICATIONS

This application claims the benefit of Korean Patent Application No. 2010-0045106 and No. 2010-0071090, filed on May 13 and Jul. 22, 2010 in the Korean Intellectual Property Office, the disclosures of which are incorporated herein by reference.

BACKGROUND

1. Field

Embodiments relate to a device and method for automatically cleaning a filter mounted in a clothes dryer to filter lint generated while drying is performed in a drum of the clothes dryer.

2. Description of the Related Art

A clothes dryer is an apparatus to dry washed wet laundry using high-temperature dry air.

Based on a power source thereof, the clothes dryer is generally classified as a gas type dryer or an electric type dryer. Based on how moisture absorbed from an object to be dried is handled, the clothing dryer is classified as an exhaust type dryer or a condensation type dryer.

In the exhaust type dryer, humid air discharged from a drum is exhausted outside via a long exhaust duct.

The condensation type dryer uses an air circulation method in which moisture is removed from humid air discharged from a drum by a heat exchanger, and resultant dry air is supplied to the drum. The flow of air forms a closed loop, with the result that gas is not used as a heat source but electricity is normally used as the heat source, thereby increasing maintenance costs. On the other hand, air is circulated between an object to be dried in the drum and the heat exchanger, with the result that an exhaust duct is not provided, thereby achieving easy installation.

Meanwhile, lint (nap or fuzz) may be generated during drying of wet clothes in the drum.

The lint moves along a channel together with air and clings to the heat exchanger in the condensation type dryer. For this reason, a filter to filter the lint is mounted in the channel at the inlet side of the heat exchanger.

When the lint accumulates on the filter, the flow of air is disturbed, with the result that heat exchange efficiency is lowered, and therefore, the performance of the dryer is deteriorated. Consequently, the filter is periodically cleaned to prevent the occurrence of such phenomena.

SUMMARY

It is an aspect to provide a clothes dryer that circulates filter cleaning water to efficiently remove lint.

Additional aspects will be set forth in part in the description which follows and, in part, will be apparent from the description, or may be learned by practice of the invention.

In accordance with one aspect, a clothes dryer includes a main body, a drum rotatably mounted in the main body to receive an object to be dried, an air channel connected to the drum to supply air into the drum and to guide air discharged from the drum, a dehumidification unit disposed in the air channel to condense moisture contained in the air discharged from the drum, a waterspout to collect condensed water created by the dehumidification unit, a filter to filter lint from the air discharged from the drum, a cleaning nozzle to spray water to the filter to remove the lint from the filter, a recovery water tank connected to the waterspout to receive water from the waterspout, and a cleaning water tank connected to the recovery water tank to receive water from the recovery water tank and to supply the water to the cleaning nozzle.

The recovery water tank may include a partition to divide an interior of the recovery water tank into a first storage chamber and a second storage chamber, and the partition may include an opening through which the first storage chamber and the second storage chamber communicate with each other.

The recovery water tank may further include a connection port communicating with the cleaning water tank to allow water stored in the first storage chamber to be supplied to the cleaning water tank therethrough, and the connection port may be located at a lower position than the opening of the partition.

The recovery water tank may further include a valve mounted in the connection port.

The valve may include a valve body to open and close the connection port and a spring to elastically bias the valve body such that the valve body closes the connection port, and the valve may be automatically controlled by buoyancy of the water in the cleaning water tank and elastic force of the spring.

The cleaning water tank may include a rod having one end rotatably coupled to the cleaning water tank and a buoyant weight mounted to the other end of the rod, and the rod may have a portion to push the valve body depending upon a position of the rod such that the connection port is opened, the portion of the rod being separated from the valve body such that the connection port is closed.

The first storage chamber may have a smaller storage capacity than the second storage chamber.

The recovery water tank may be detachably mounted to the cleaning water tank.

The recovery water tank may include an inlet to allow water from the waterspout to be introduced therethrough and a water tank filter disposed in the inlet to filter lint from the water.

The cleaning water tank may include a pump to pump water to the cleaning nozzle.

The cleaning water tank may be provided at a bottom thereof with a lower portion, which is lower than other portions, and the pump may be mounted at the lower portion of the cleaning water tank.

The cleaning nozzle may include a nozzle inlet, a nozzle body, and a spray port, the nozzle body may extend to opposite sides of the nozzle inlet such that the nozzle body is perpendicular to a direction in which water supplied through the nozzle inlet advances, and the spray port may be provided at an end of the nozzle body in a slit shape.

The nozzle body may have an inner wall round at one side thereof, by which water is uniformly sprayed through the spray port.

The clothes dryer may further include a hose connected between the pump and the cleaning nozzle such that the hose is horizontally connected to the cleaning nozzle in front of the cleaning nozzle.

The cleaning water tank may include an outlet to allow water to be discharged therethrough and an opening and closing device to open and close the outlet.

The opening and closing device may include a valve arm rotatably mounted in the cleaning water tank, the valve arm being provided at one end thereof with an opening and closing part to open and close the outlet, an arm spring to elastically bias the other end of the valve arm such that the outlet is closed by the opening and closing part, and a pushing unit to push the valve arm such that the outlet is opened by the opening and closing part.

The cleaning nozzle may include a nozzle inlet, a nozzle body, and a spray port, the nozzle body may extend to one side of the nozzle inlet such that the nozzle body is perpendicular to a direction in which water supplied through the nozzle inlet advances, and the spray port may be provided at an end of the nozzle body in a slit shape, the spray port having a width gradually increased as the spray port becomes distant from the nozzle inlet.

The spray port of the cleaning nozzle may include a first sidewall disposed in front of one side of the filter and a second sidewall disposed closer to the filter than the first sidewall, and the first sidewall may protrude farther downward than the second sidewall.

The clothes dryer may further include a hose connected between the outlet and the cleaning nozzle, the hose extending downward from the outlet to the cleaning nozzle such that water supplied to the cleaning nozzle via the hose falls due to the force of gravity and reaches the cleaning nozzle.

The humidification unit may include an evaporator, a compressor, a condenser, and an expansion valve, and the evaporator may generate the condensed water.

In accordance with another aspect, a clothes dryer includes a main body, a drum rotatably mounted in the main body to receive an object to be dried, an air channel connected to the drum to supply air into the drum and to guide air discharged from the drum, a filter mounted in the air channel to filter lint from the air, a dehumidification unit disposed in the air channel to condense moisture contained in the air discharged from the drum, a cleaning nozzle to spray water into the air channel to clean components mounted in the air channel, a waterspout to collect condensed water created by the dehumidification unit, a cleaning water tank to supply water to the cleaning nozzle, and a recovery water tank connected to the waterspout to receive water from the waterspout and to supply the water to the cleaning water tank, the recovery water tank being detachably mounted to the cleaning water tank.

The recovery water tank may include a partition to divide an interior of the recovery water tank into a first storage chamber and a second storage chamber, and the partition may include an opening through which the first storage chamber and the second storage chamber communicate with each other.

The recovery water tank may further include a connection port communicating with the cleaning water tank to allow water stored in the first storage chamber to be supplied to the cleaning water tank therethrough, and the connection port may be located at a lower position than the opening of the partition.

The recovery water tank may further include a valve mounted in the connection port.

The valve may include a valve body to open and close the connection port and a spring to elastically bias the valve body such that the valve body closes the connection port, and the valve may be automatically controlled by buoyancy of the water in the cleaning water tank and elastic force of the spring.

The cleaning water tank may include a rod having one end rotatably coupled to the cleaning water tank and a buoyant weight mounted to the other end of the rod, and the rod may have a portion to push the valve body depending upon a position of the rod such that the connection port is opened, the portion of the rod being separated from the valve body such that the connection port is closed.

The first storage chamber may have a smaller storage capacity than the second storage chamber.

The cleaning water tank may include a pump to pump water to the cleaning nozzle.

The cleaning water tank may include an outlet to allow water to be discharged therethrough and an opening and closing device to open and close the outlet.

In accordance with a further aspect, a clothes dryer, having a dehumidification unit to condense moisture contained in air drying an object to be dried while circulating in a main body and a filter mounted in front of the dehumidification unit to filter lint from the air, includes a cleaning water tank to store water to clean the filter, a recovery water tank communicating with the cleaning water tank to supply water to the cleaning water tank, a cleaning nozzle to spray the water received from the cleaning water tank to the filter, and a waterspout provided below the dehumidification unit and the filter to collect condensed water created by the dehumidification unit and the water sprayed from the cleaning nozzle and to supply water to the recovery water tank, wherein the recovery water tank includes a water tank filter disposed in an inlet thereof to filter lint from the water supplied from the waterspout, and the recovery water tank is detachably mounted to the cleaning water tank.

The cleaning water tank may include a pump to pump water to the cleaning nozzle.

The cleaning nozzle may include a nozzle inlet, a nozzle body, and a spray port, the nozzle body may extend to opposite sides of the nozzle inlet such that the nozzle body is perpendicular to a direction in which water supplied through the nozzle inlet advances, the spray port may be provided at an end of the nozzle body in a slit shape, the nozzle body may have an inner wall round at one side thereof, by which water is uniformly sprayed through the spray port, and the clothes dryer may further include a hose connected between the pump and the cleaning nozzle such that the hose is horizontally connected to the cleaning nozzle in front of the cleaning nozzle.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
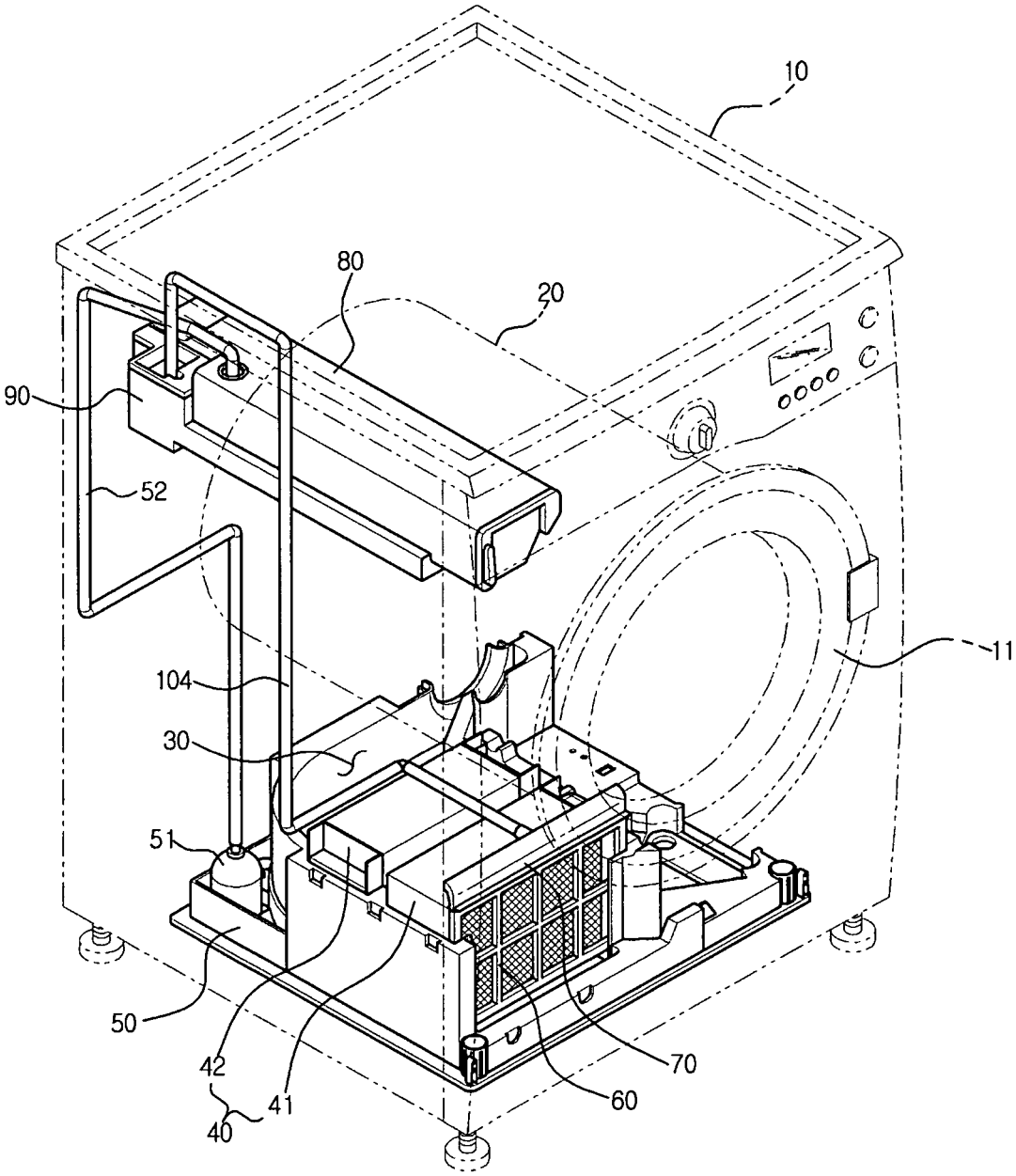
FIG. 1 is a perspective view schematically illustrating a clothes dryer according to an embodiment.

Reference will now be made in detail to the embodiments, examples of which are illustrated in the accompanying drawings, wherein like reference numerals refer to like elements throughout.

FIG. 1 is a perspective view schematically illustrating a clothes dryer according to an embodiment.

Referring to FIG. 1, the clothes dryer includes a main body 10, a drum 20, an air channel 30, a dehumidification unit 40, a waterspout 50, a filter 60, a cleaning nozzle 70, a recovery water tank 80, and a cleaning water tank 90.

In the front of the main body 10 is formed an introduction port, through which objects to be dried, such as clothes, are introduced into the drum 20. A door 11 is hingedly coupled to the edge of the main body 10 at one side thereof.

The drum 20 is rotatably mounted in the main body 10 to receive clothes. The clothes are dried by air circulating along the air channel 30 in the main body 10 while being rotated in the drum 20.

Humid air discharged from the drum 20 is dried while passing through the humidification unit 40 via the air channel 30, and is then supplied into the drum 20 along the air channel 30.

A blowing fan (not shown) mounted on the air channel 30 accelerates the air.

The humidification unit 40, including an evaporator 41, a compressor (not shown), a condenser 42, and an expansion valve (not shown), removes moisture from the air circulating along the air channel 30 using a refrigerant cycle.

That is, the air containing the moisture is condensed while passing through the evaporator 41 such that the moisture is removed from the air, and the air is heated while passing through the condenser 42.

A heater may be mounted in the dryer to heat air to be introduced into the drum, thereby improving drying efficiency of the dryer.

Air absorbing the moisture from the clothes, i.e., humid air, flows to the evaporator of the humidification unit 40 along the air channel 30. As a result of heat exchange between the evaporator 41 and the humid air, the moisture in the air is condensed into condensed water. The condensed water falls and is collected into the waterspout 50 located below the humidification unit 40. The collected water is transferred to the recovery water tank 80 located at the upper end of the main body 10 via a hose 52 by a pump 51 mounted in the waterspout 50.

The water collected in the waterspout 50 contains lint generated during drying of the clothes. When the water moves toward the pump 51, a whirlpool occurs, with the result that the lint may gather in the waterspout 50.

Therefore, the dryer may be designed such that the water collected in the waterspout 50 reaches the pump 51 in a straight line so as to prevent the occurrence of the whirlpool.

That is, the lower end of the waterspout 50 may be inclined such that the pump 51 is located at a lowermost portion of the lower end of the waterspout 50.

The pump 51 transfers a large amount of water when the pump 51 is more deeply immersed in water. At this time, lint suction force of the pump 51 is further increased. Therefore, the dryer may be designed such that the pump 51 is deeply immersed in water.

Also, the pump 51 has a large suction port, through which the lint is easily suctioned into the pump 51.

The filter 60, which filters the lint, is located in the air channel 30 in front of the dehumidification unit 40. The waterspout 50 is disposed to collect air which is sprayed from the cleaning nozzle 70 to clean the filter 60 and, as a result, contains the lint.

In the above structure, the water created by the dehumidification unit 40 and collected in the waterspout 50 is used to clean the filter 60. After that, the water is collected in the waterspout 50 and is then transferred to the recovery water tank 80 located at the upper part of the dryer by pumping of the pump mounted in the waterspout 50. Consequently, the water may be repeatedly used to clean the filter 60.

Hereinafter, the structure and operation of the recovery water tank 80 and the cleaning water tank 90 of the clothes dryer of FIG. 1 will be described.

Figure 2:
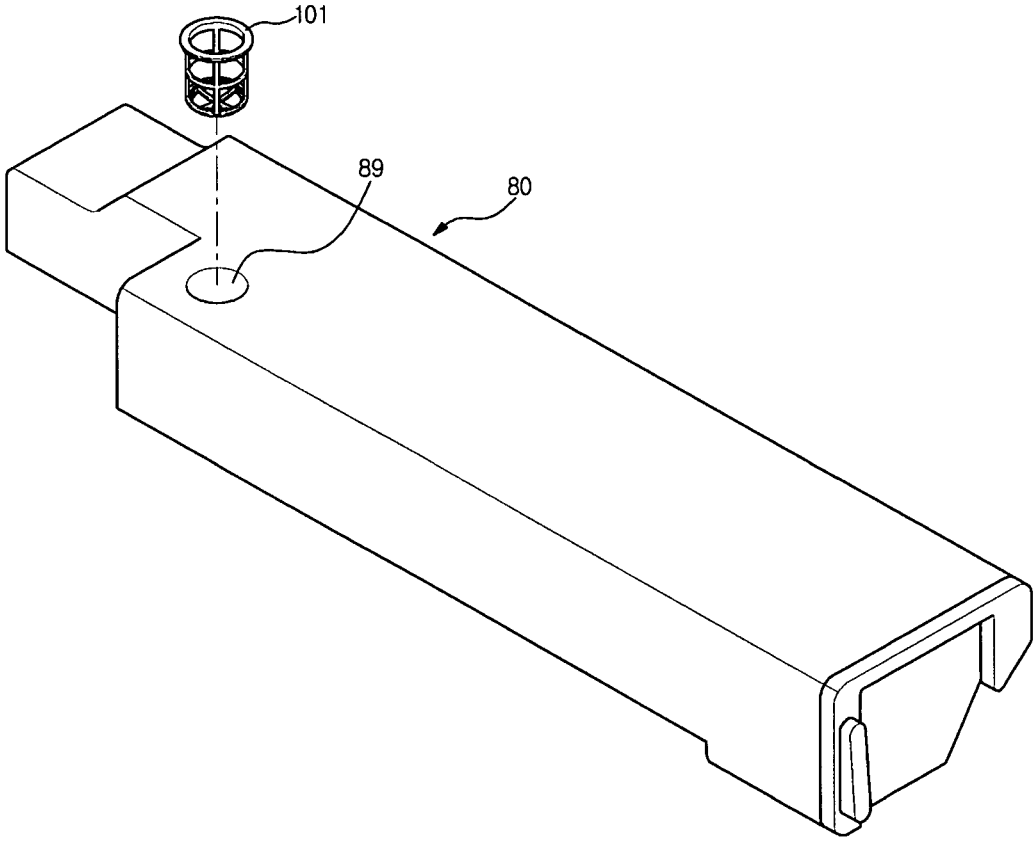
FIG. 2 is a view illustrating the structure of a recovery water tank of the clothes dryer of FIG. 1.
Figure 3:
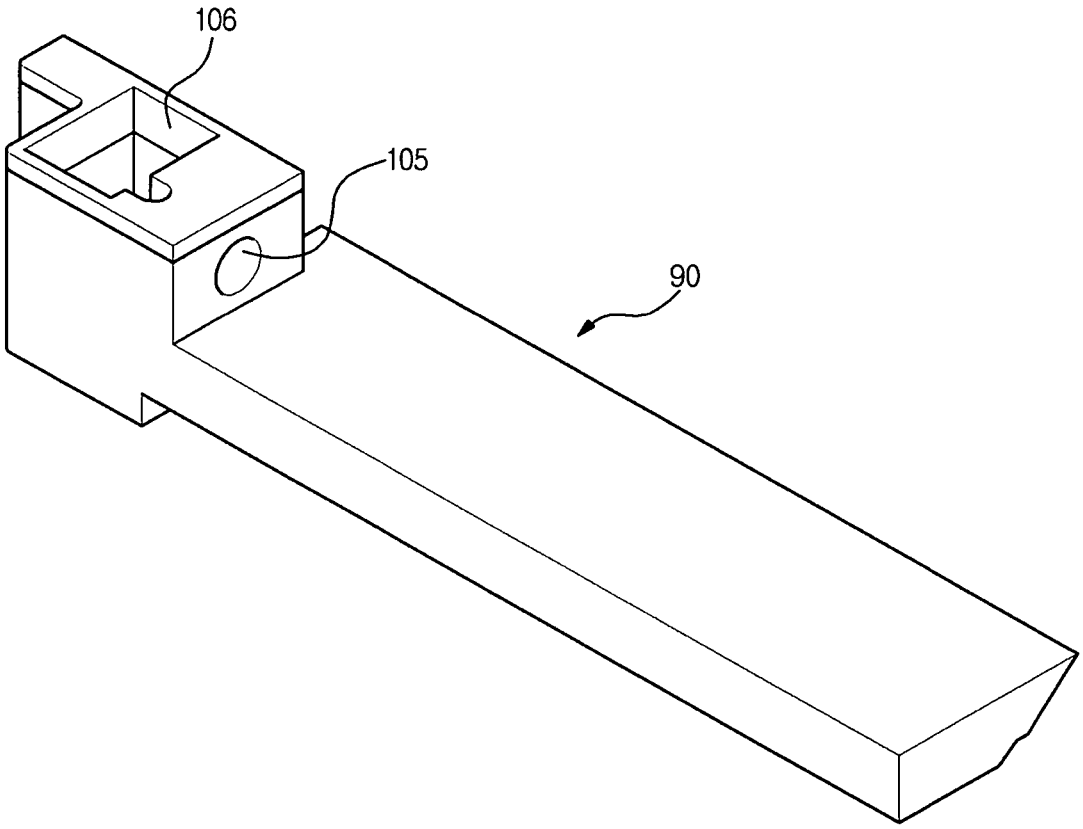
FIG. 3 is a view illustrating the structure of a cleaning water tank of the clothes dryer of FIG. 1.
Figure 4:
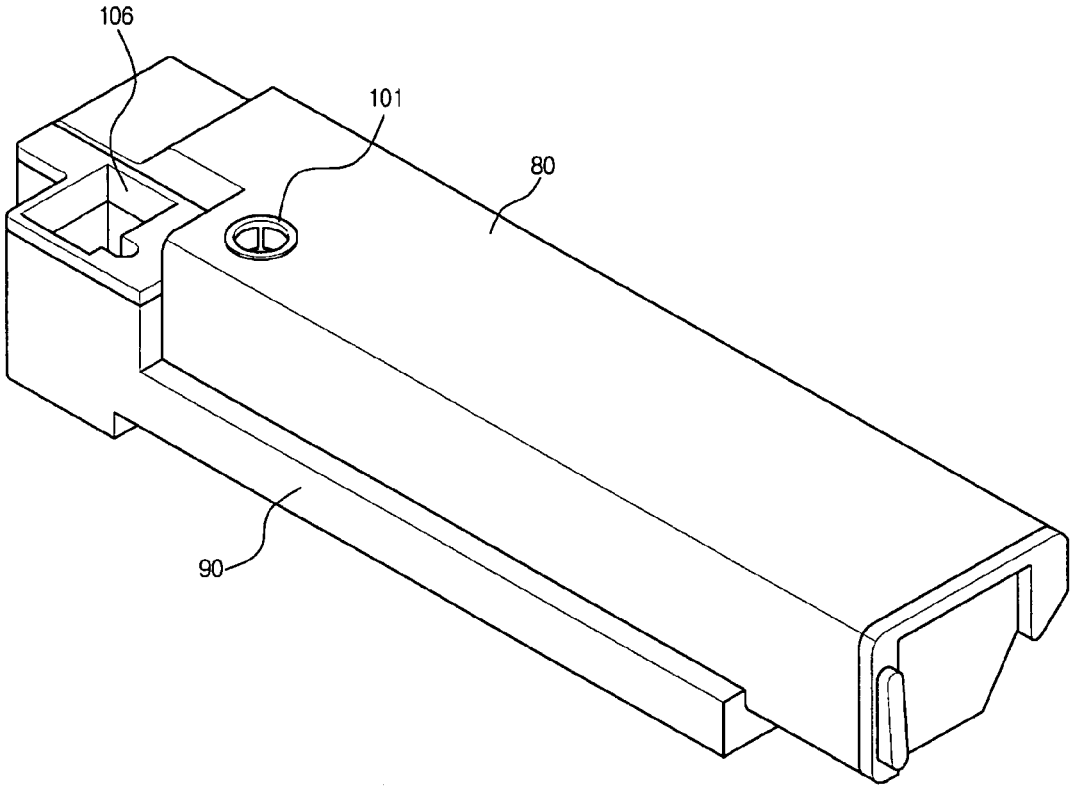
FIG. 4 is a view illustrating the coupling between the recovery water tank and the cleaning water tank of the clothes dryer of FIG. 1.

FIG. 2 is a view illustrating the structure of the recovery water tank of the clothes dryer of FIG. 1, FIG. 3 is a view illustrating the structure of the cleaning water tank of the clothes dryer of FIG. 1, and FIG. 4 is a view illustrating the coupling between the recovery water tank and the cleaning water tank of the clothes dryer of FIG. 1.

Figure 5:
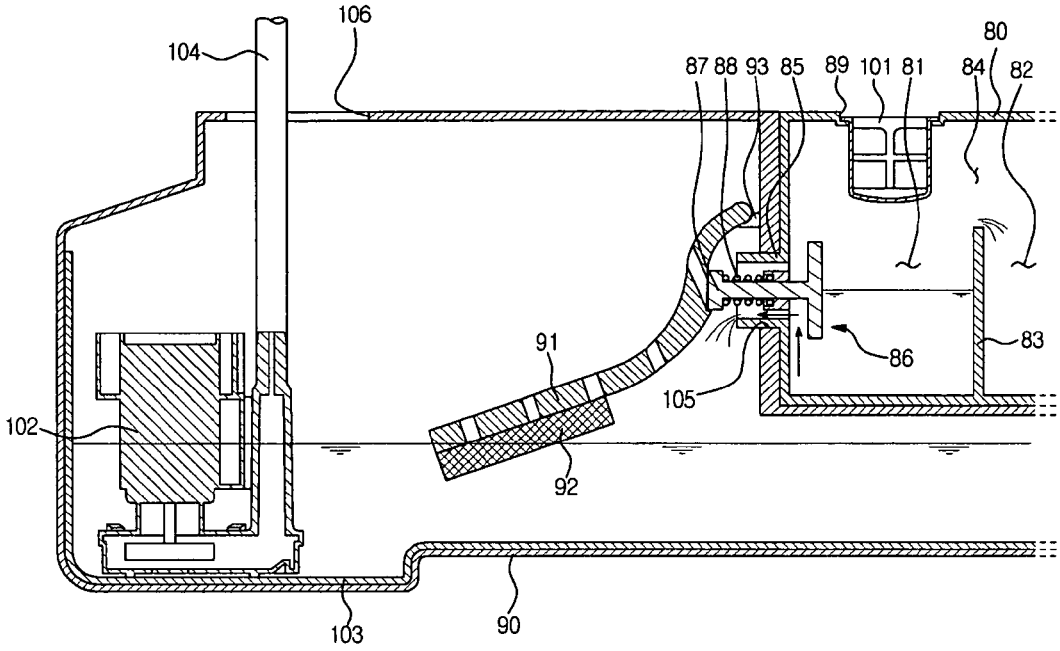
FIG. 5 is a sectional view illustrating an open state of a connection port of the recovery water tank of the clothes dryer of FIG. 1.
Figure 6:
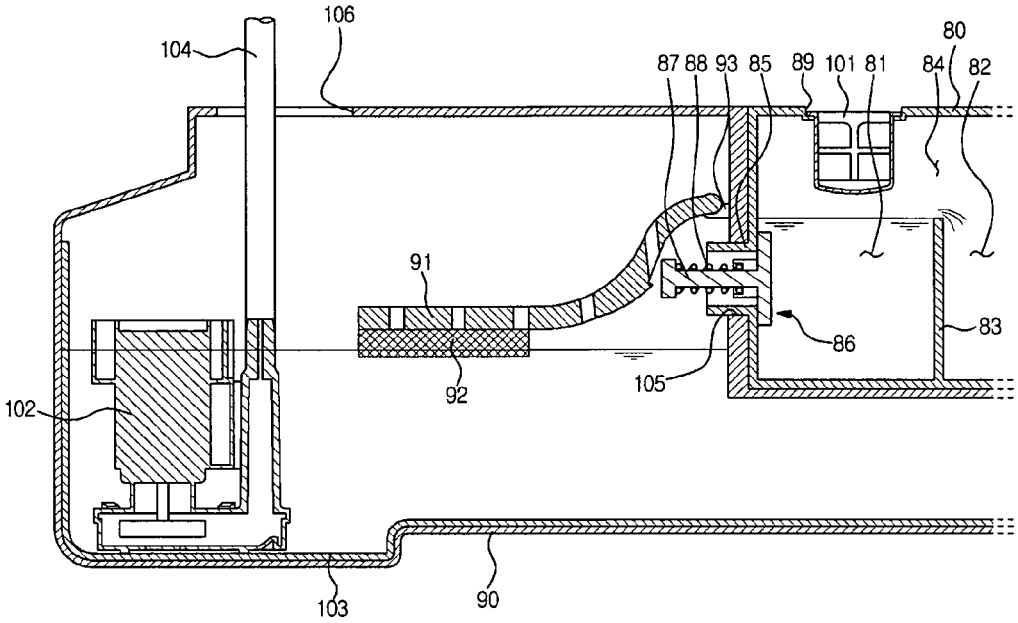
FIG. 6 is a sectional view illustrating a closed state of the connection port of the recovery water tank of the clothes dryer of FIG. 1.

FIG. 5 is a sectional view illustrating an open state of a connection port of the recovery water tank of the clothes dryer of FIG. 1, and FIG. 6 is a sectional view illustrating a closed state of the connection port of the recovery water tank of the clothes dryer of FIG. 1.

The recovery water tank 80 and the cleaning water tank 90 constitute a water tank of the clothes dryer of FIG. 1.

The recovery water tank 80 is formed generally in a flat shape. The recovery water tank 80 is provided at the upper part thereof with a recovery water tank inlet 89, in which a water tank filter 101 is mounted.

The recovery water tank 80 is provided at one side thereof with a connection port 85 protruding outward to communicate with the cleaning water tank 90.

The cleaning water tank 90 is formed in a flat shape such that the recovery water tank 80 is disposed at the top of the cleaning water tank 90 in a tight contact manner. A portion of the cleaning water tank 90 protrudes upward. The upwardly protruding portion of the cleaning water tank 90 is provided with a cleaning water tank inlet 105 corresponding to the connection port 85 of the recovery water tank 80.

The connection port 85 of the recovery water tank 80 is inserted into the inlet 105 of the cleaning water tank 90, thereby achieving communication between the cleaning water tank 90 and the recovery water tank 80.

The recovery water tank 80 includes a first storage chamber 81 and a second storage chamber 82 divided by a partition 83.

The first storage chamber 81 may be smaller than the second storage chamber 82.

The partition 83 is disposed in the recovery water tank 80 such that the first storage chamber 81 and a second storage chamber 82 are not completely isolated from each other but an opening 84 is defined at the upper part of the recovery water tank 80.

When water introduced into the first storage chamber 81 reaches the upper end of the partition 83, therefore, the water flows into the second storage chamber 82 over the partition 83.

The inlet 89 of the recovery water tank 80 is provided at the upper part of the first storage chamber 81 such that water collected in the waterspout 50 flows into the first storage chamber 81.

Also, the water tank filter 101 is mounted in the inlet 89 of the recovery water tank 80 to filter lint from water to be introduced into the recovery water tank 80.

The connection port 85, protruding outward from the recovery water tank 80, is provided in the first storage chamber 81. The connection port 85 of the recovery water tank 80 is inserted into the inlet 105 of the cleaning water tank 90, thereby achieving communication between the cleaning water tank 90 and the recovery water tank 80, as previously described.

Also, the connection port 85 is located at a lower position than the upper end of the partition 83 of the recovery water tank 80, and therefore, the water introduced into the first storage chamber 81 flows into the cleaning water tank 90 through the connection port 85 before rising to the height of the partition 83.

In the connection port 85 is mounted a valve 86 including a valve body 87 and a spring 88.

The spring 88 elastically biases the valve body 87 such that the valve body 87 closes the connection port 85.

The cleaning water tank 90 includes a hinge 93 and a rod 91.

The hinge 93 is mounted at the inside upper end of the side of the cleaning water tank 90 contacting the connection port 85 of the recovery water tank 80. One end of the rod 91 is coupled to the hinge 93 such that the rod 91 rotates about the hinge 93, and a buoyant weight 92 is mounted to the other end of the rod 91.

When the cleaning water tank 90 is filled with water, therefore, the rod 91 rotates in the clockwise direction due to buoyancy applied to the buoyant weight 92. When the water is drained out of the cleaning water tank 90, on the other hand, the rod rotates in the counterclockwise direction due to the force of gravity.

The valve 86 mounted in the connection port 85 opens and closes the connection port 85 through the above operation of the rod 91 of the cleaning water tank 90.

That is, when the cleaning water tank 90 is empty, the rod 91 of the cleaning water tank 90 rotates in the counterclockwise direction due to the force of gravity to push the valve body 87, with the result that the connection port 85 is opened.

The water from the first storage chamber 81 of the recovery water tank 80 is introduced into the cleaning water tank 90 through the open connection port 85. As the cleaning water tank 90 is filled with water, the rod 91 rotates in the clockwise direction due to buoyancy applied to the buoyant weight 92. When the water reaches a predetermined water level, the rod 91 is separated from the valve body 87, and the valve body 87 closes the connection port 85 due to elastic force of the spring 88.

Meanwhile, the cleaning water tank 90 includes a pump 102 to suction water in the cleaning water tank 90 and forward the suctioned water to the cleaning nozzle 70 via a hose 104.

At the bottom of the cleaning water tank 90 is provided a lower portion 103, which is lower than other portions of the bottom of the cleaning water tank 90. The pump 102 is mounted at the lower portion 103 such that suction force of the pump 102 is increased.

Figure 9:
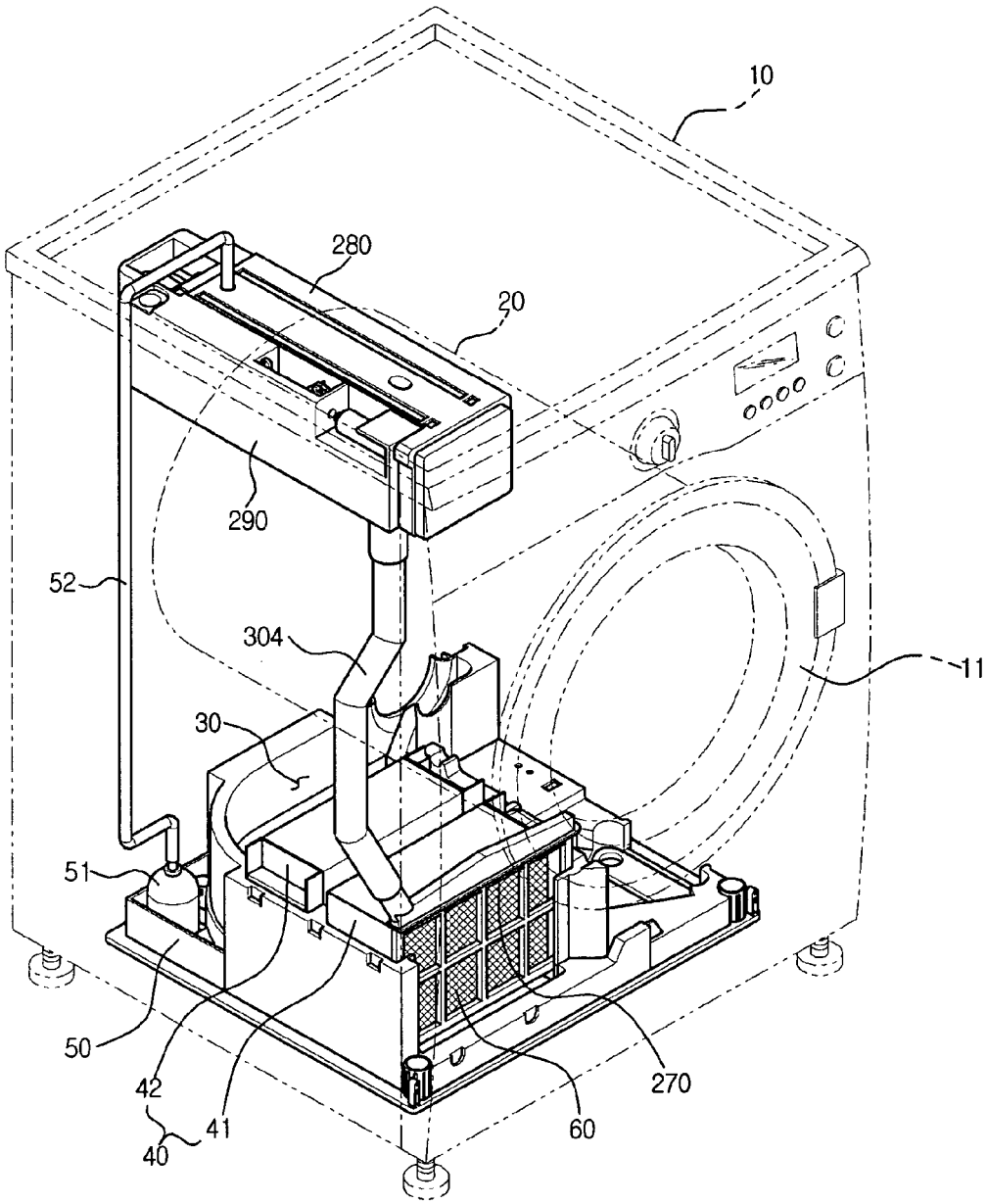
FIG. 9 is a perspective view schematically illustrating a clothes dryer according to another embodiment of the present invention.

In the clothes dryer of FIG. 1, water is supplied from the cleaning water tank 90 to the cleaning nozzle 70 using the pump 102, which is different from a clothes dryer of FIG. 9, in which water is supplied using an opening and closing device 294. The clothes dryer of FIG. 1 has lower flow rate but higher pressure than the clothes dryer of FIG. 9.

Therefore, the cleaning nozzle 70 of the clothes dryer of FIG. 1 is different in structure from a cleaning nozzle 290 of the clothes dryer of FIG. 9.

Hereinafter, the structure and operation of the cleaning nozzle 70 will be described with reference to the accompanying drawings.

Figure 7:
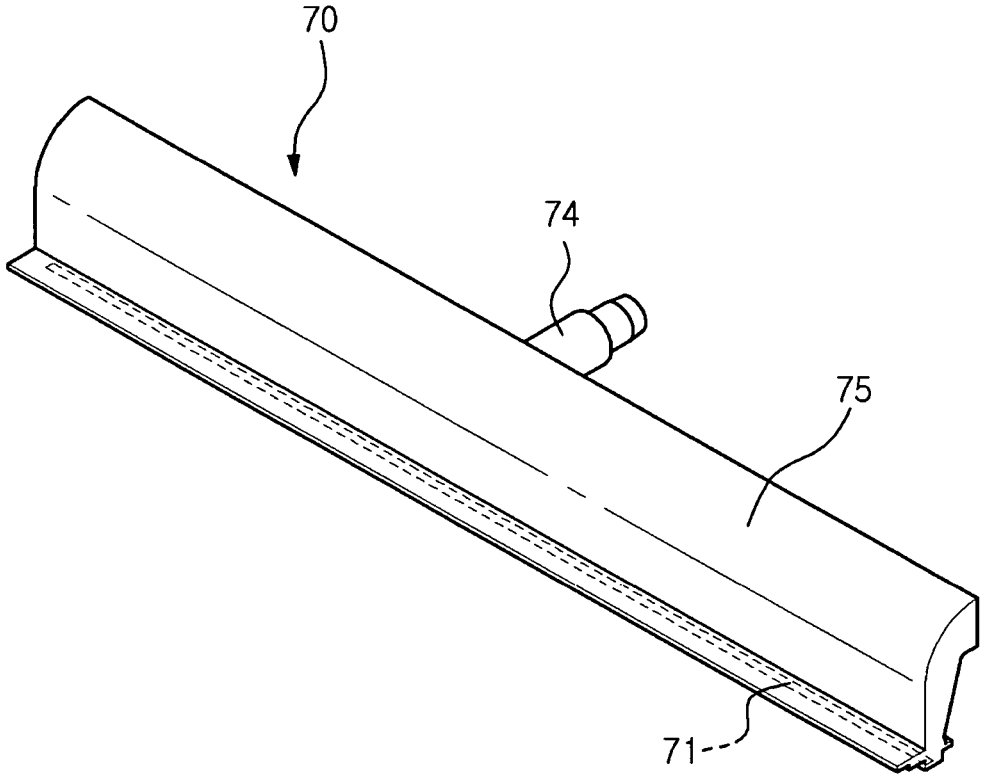
FIG. 7 is a perspective view illustrating a cleaning nozzle of the clothes dryer of FIG. 1.
Figure 8:
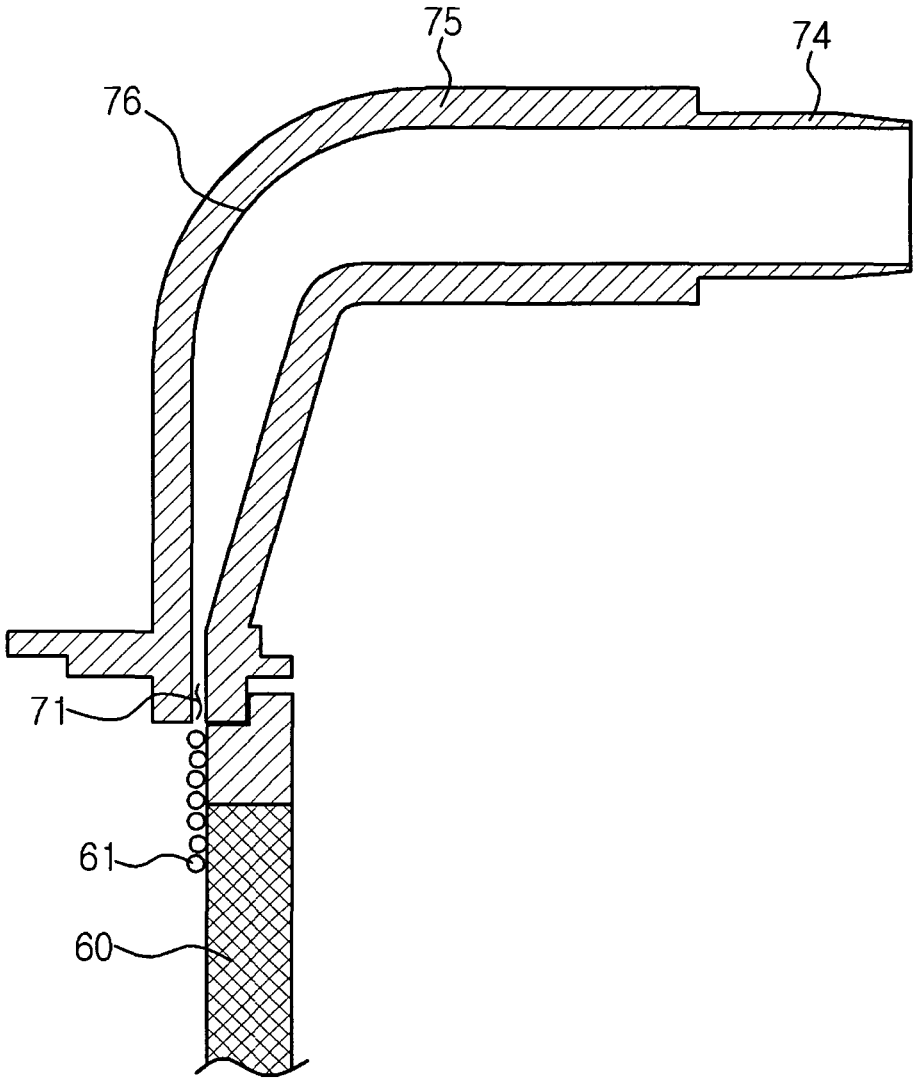
FIG. 8 is a sectional view illustrating the cleaning nozzle of the clothes dryer of FIG. 1.

FIG. 7 is a perspective view illustrating the cleaning nozzle of the clothes dryer of FIG. 1, and FIG. 8 is a sectional view illustrating the cleaning nozzle of the clothes dryer of FIG. 1.

The cleaning nozzle 70 includes a nozzle inlet 74, a nozzle body 75, and a spray port 71.

The nozzle inlet 74 is connected to the pump 102 through the opening 106 of the cleaning water tank 90 via the hose 104 such that water is supplied to the cleaning nozzle 70 by pumping of the pump 102.

The hose 104 is horizontally connected to the nozzle inlet 74 in front of the nozzle inlet 74.

The nozzle body 75 extends to opposite sides of the nozzle inlet 74 such that the nozzle body 75 is perpendicular to the direction in which water supplied through the nozzle inlet 74 advances. The spray port 71 is provided at the end of the nozzle body 74 in a slit shape.

Also, an inner wall 76 of the nozzle body 75 is round at one side thereof such that water is uniformly sprayed through the spray port 71 of the cleaning nozzle 70.

That is, water introduced into the nozzle body 75 through the nozzle inlet 74 collides with the round wall of the nozzle body 75, with the result that the water is widely spread along the wall of the nozzle body 75.

The water tank is operated as follows.

Water, collected in the waterspout 50, is introduced into the first storage chamber 81 of the recovery water tank 80 provided at the upper end of the main body 10 of the dryer via the hose 52 by the pumping of the pump 51 mounted in the waterspout 50.

The water introduced into the first storage chamber 81 flows into the cleaning water tank 90 through the connection port 85. When the water in the cleaning water tank 90 reaches a predetermined level, the rod disposed in the cleaning water tank 90 is separated from the valve body 87, and the connection port 85 is closed due to elastic force of the spring 88.

When water continues to flow from the waterspout 50 into the first storage chamber 81, the water flows over the partition 83 and is introduced into the second storage chamber 82 through the opening 84.

The water in the cleaning water tank 90 is supplied to the spray nozzle 70 via the hose 104 by the pumping of the pump 102 provided in the cleaning water tank 90. The water is uniformly sprayed to the filter 60 from the spray nozzle 70 to remove lint 61 from the filter 60.

The water used to remove lint 61 from the filter 60 is collected in the waterspout 50 and is forwarded to the recovery water tank 80 via the hose 52 by the pumping of the pump 51 mounted in the waterspout 50.

At this time, the lint 61 is filtered out from the water by the water tank filter 101 mounted in the inlet 89 of the recovery water tank 80.

During such circulation, a user may separate the recovery water tank 80 from the cleaning water tank 90, drain the water from the recovery water tank 80, and remove the lint from the water tank filter 101.

The lint may be easily removed from the water tank filter 101 by simply draining the water in the recovery water tank 80 through the inlet 89 of the recovery water tank 80.

Next, a clothes dryer according to another embodiment will be described.

Figure 10:
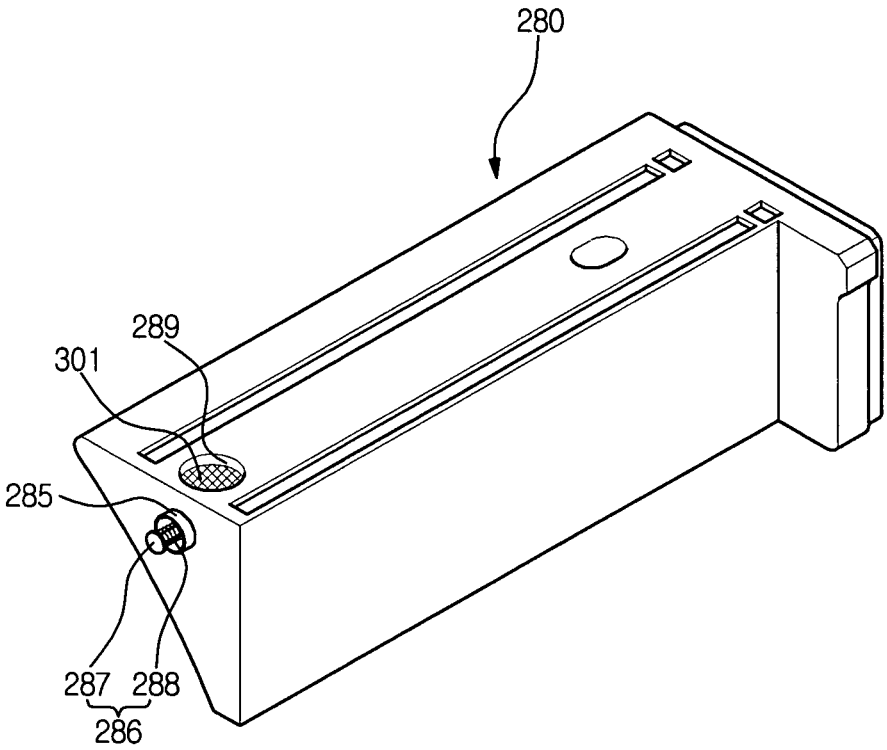
FIG. 10 is a view illustrating the structure of a recovery water tank of the clothes dryer of FIG. 9.
Figure 11:
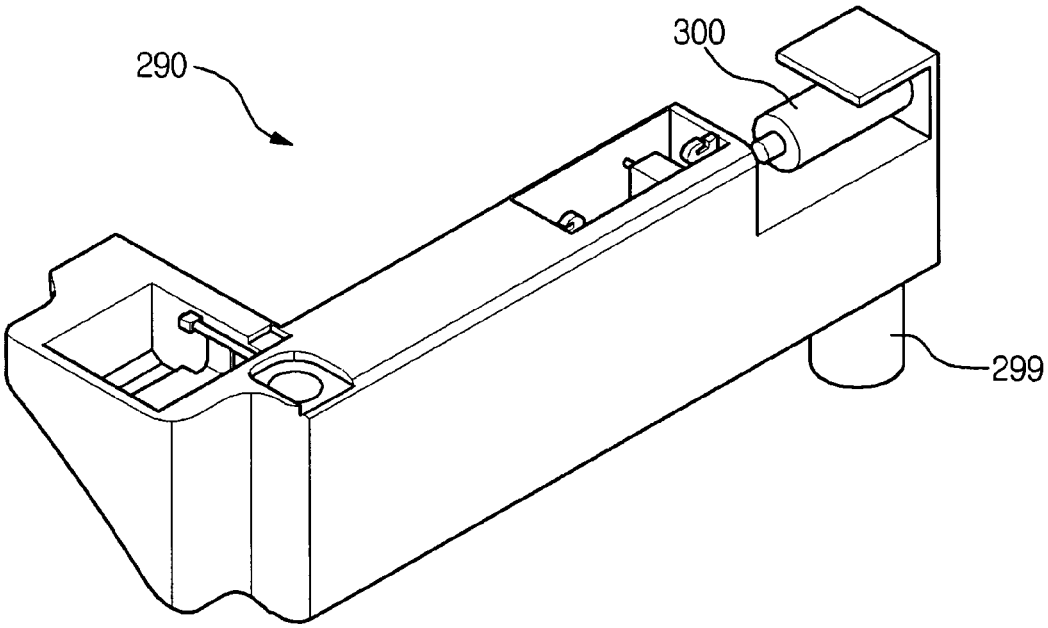
FIG. 11 is a view illustrating the structure of a cleaning water tank of the clothes dryer of FIG. 9.
Figure 12:
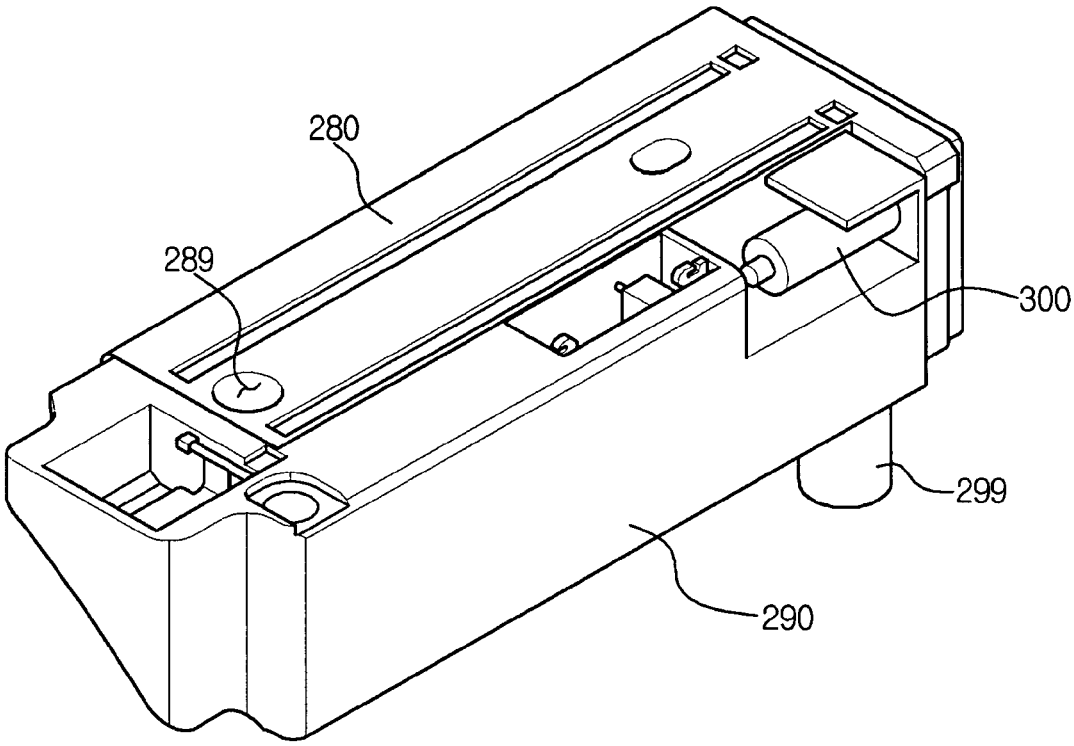
FIG. 12 is a view illustrating the coupling between the recovery water tank and the cleaning water tank of the clothes dryer of FIG. 9.

FIG. 9 is a perspective view schematically illustrating a clothes dryer according to another embodiment of the present invention, FIG. 10 is a view illustrating the structure of a recovery water tank of the clothes dryer of FIG. 9, FIG. 11 is a view illustrating the structure of a cleaning water tank of the clothes dryer of FIG. 9, and FIG. 12 is a view illustrating the coupling between the recovery water tank and the cleaning water tank of the clothes dryer of FIG. 9.

Referring to FIGS. 9 to 12, the clothes dryer of FIG. 9 is identical to the clothes dryer of FIG. 1 except that a recovery water tank 280, a cleaning water tank 290, and a cleaning nozzle 270 of the clothes dryer of FIG. 9 are different in structure from those of the clothes dryer of FIG. 1, and connection between a hose 304 and the cleaning nozzle 270 of the clothes dryer of FIG. 9 is different from that of the clothes dryer of FIG. 1.

In the clothes dryer of FIG. 1, the water tank is divided horizontally into the recovery water tank 80 and the cleaning water tank 90. In the clothes dryer of FIG. 9, on the other hand, a water tank is divided vertically into the recovery water tank 280 and the cleaning water tank 290.

The recovery water tank 280 is provided at one side thereof with a connection port 285 protruding outward to communicate with the cleaning water tank 290. In the connection port 285 is mounted a valve 286 including a valve body 287 and a spring 288.

The water tank of the clothes dryer of FIG. 1 or the water tank of the clothes dryer of FIG. 9 may be selectively used according to the internal form of the dryer or arrangement of components in the dryer.

The clothes dryer of FIG. 9 is different from the clothes dryer of FIG. 1 in terms of a method of supplying water from the cleaning water tank 290 to the cleaning nozzle 270.

In the clothes dryer of FIG. 9, an outlet 299 is temporarily opened, instead of pumping, to supply water in the cleaning water tank 290 to the cleaning nozzle 270.

Figure 13:
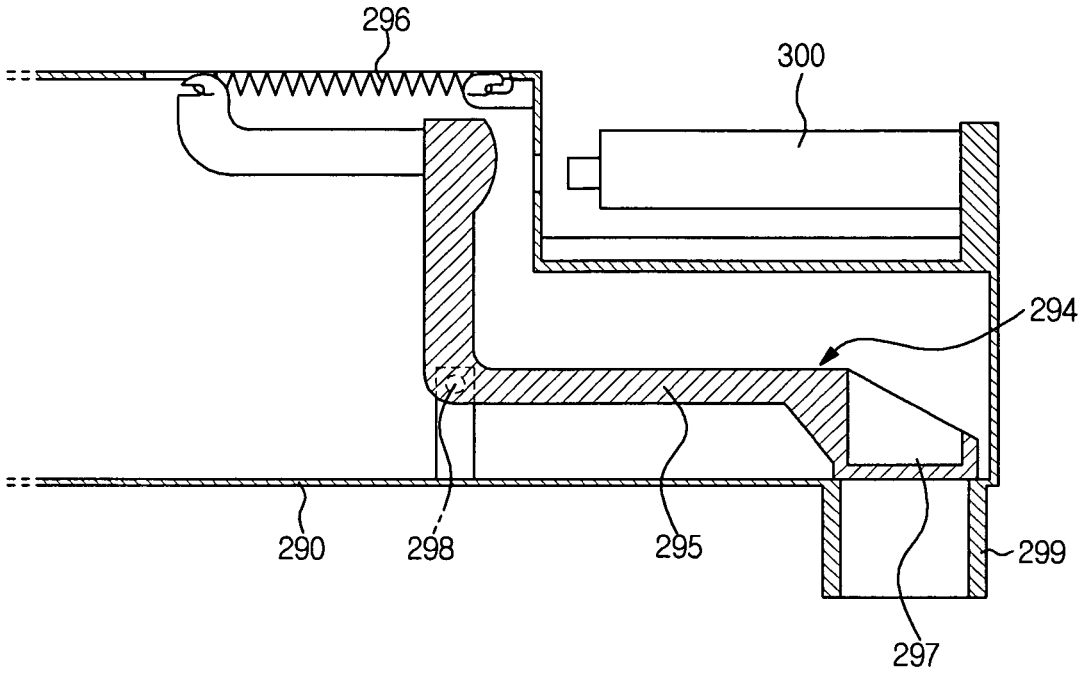
FIG. 13 is a sectional view illustrating a closed state of an opening and closing device of the cleaning water tank of the clothes dryer of FIG. 9.

To this end, the cleaning water tank 290 includes the outlet 299 protruding downward and an opening and closing device 294 (see FIG. 13). The outlet 299 is connected to the cleaning nozzle 270 via the hose 304.

When the outlet 299 is temporarily opened by the opening and closing device 294, a large amount of water is supplied to the cleaning nozzle 270 via the hose 304.

In the clothes dryer of FIG. 9, therefore, the hose 304 extends downward to interconnect the cleaning water tank 290 and the cleaning nozzle 270 such that water reaches the cleaning nozzle 270 due to the force of gravity.

Figure 14:
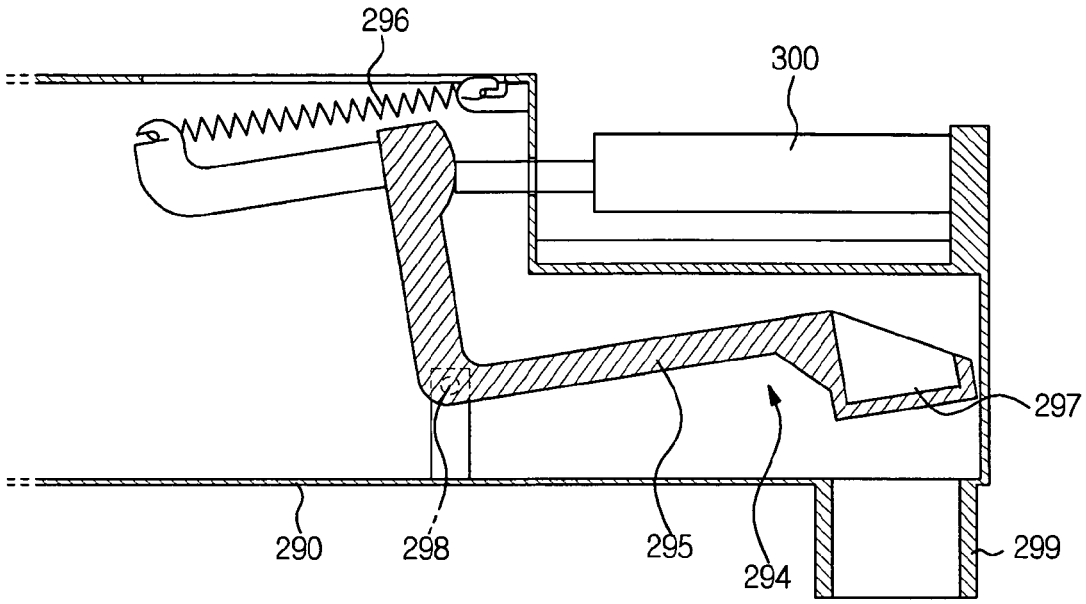
FIG. 14 is a sectional view illustrating an open state of the opening and closing device of the cleaning water tank of the clothes dryer of FIG. 9.

FIG. 13 is a sectional view illustrating a closed state of the opening and closing device of the cleaning water tank of the clothes dryer of FIG. 9, and FIG. 14 is a sectional view illustrating an open state of the opening and closing device of the cleaning water tank of the clothes dryer of FIG. 9.

Referring to FIGS. 13 and 14, the outlet 299 of the cleaning water tank 290 is normally closed by the opening and closing device 294. When the outlet 299 of the cleaning water tank 290 is opened, water in the cleaning water tank 290 is supplied to the cleaning nozzle 270 via the hose 304.

The opening and closing device 294 includes a valve arm 295 formed in a shape. The valve arm 295 is hingedly coupled to a hinge 298 mounted in the cleaning water tank 290.

The valve arm 295 is provided at one end thereof with an opening and closing part 297 having a flat section to close the outlet 299. The other end of the valve arm 295 is connected to an arm spring 296 to elastically bias the other end of the valve arm 295 such that the outlet 299 is closed by the opening and closing part 297.

The cleaning water tank 290 is provided at the outside thereof with a pushing unit 300 to push the valve arm 295 such that the valve arm 295 is rotated about the hinge 298 in the clockwise direction, whereby the opening and closing part 297 is separated from the outlet 299, and therefore, the outlet 299 is closed.

When a user drives the pushing unit 300 to push the valve arm 295 of the opening and closing device 294 so as to perform cleaning, therefore, the valve arm 295 is rotated about the hinge 298 in the counterclockwise direction. As a result, the outlet 299 is opened by the opening and closing part 297, and therefore, water in the cleaning water tank 290 is discharged through the outlet 299.

Figure 15:
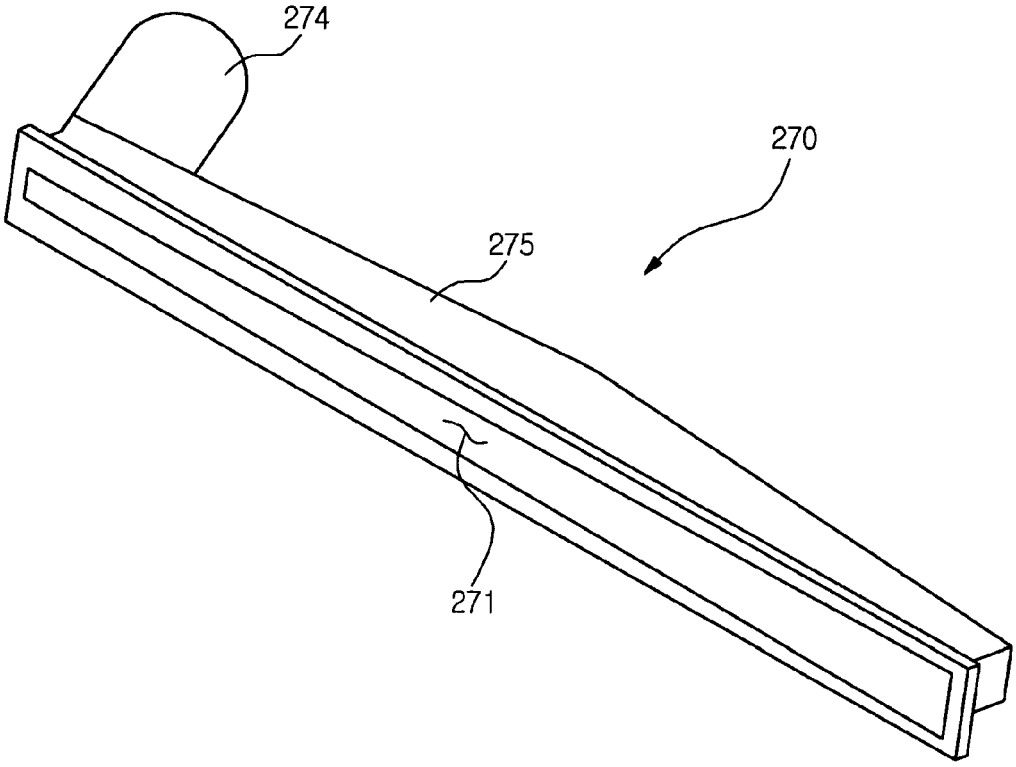
FIG. 15 is a perspective view illustrating a spray port of a cleaning nozzle of the clothes dryer of FIG. 9.
Figure 16:
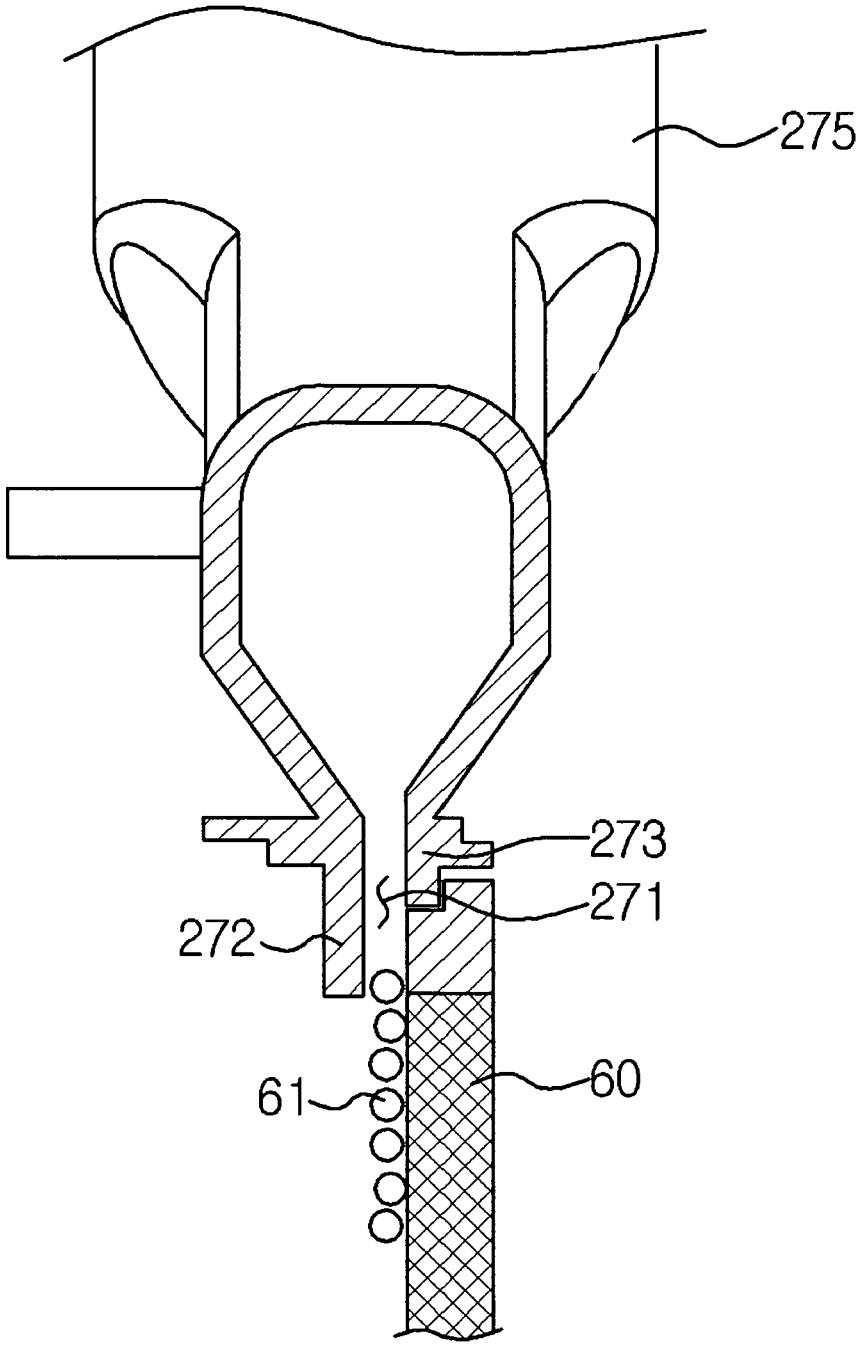
FIG. 16 is an enlarged sectional view illustrating the cleaning nozzle and a filter of the clothes dryer of FIG. 9.

FIG. 15 is a perspective view illustrating a spray port of the cleaning nozzle of the clothes dryer of FIG. 9, and FIG. 16 is an enlarged sectional view illustrating the cleaning nozzle and a filter of the clothes dryer of FIG. 9.

Hereinafter, the structure of the cleaning nozzle 270 of the clothes dryer of FIG. 9 will be described with reference to FIGS. 15 and 16.

The cleaning nozzle 270 includes a nozzle inlet 274, a nozzle body 275, and a spray port 271. The nozzle body 275 extends to one side of the nozzle inlet 274 such that the nozzle body 275 is perpendicular to the direction in which water supplied through the nozzle inlet 274 advances.

Water supplied to the cleaning nozzle 270 via the hose 304 flows to the cleaning nozzle 270. To this end, the hose 304 connected between the outlet 299 of the cleaning water tank 290 and the cleaning nozzle 270 extends downward from the outlet 299 to the cleaning nozzle 270, as previously described.

The spray port 271 of the cleaning nozzle 270 is provided at the end of the nozzle body 74 in a slit shape. The width of the spray port 271 is gradually increased as the spray port 271 becomes distant from the nozzle inlet 274.

That is, the spray port 271 of the cleaning nozzle 270 is formed in a long trapezoidal shape.

In the above structure, when the outlet 299 of the cleaning water tank 290 is opened, and therefore, a large amount of water is supplied to the nozzle inlet 274 via the hose 304, the water moves along an internal channel of the nozzle body 275 in the direction in which the water becomes distant from the nozzle inlet 274 and is then uniformly sprayed through the spray port 271 since the width of the spray port 271 near the nozzle inlet 274 is small, and the width of the spray port 271 distant from the nozzle inlet 274 is large.

The spray port 271 of the cleaning nozzle 270 includes a first sidewall 272 disposed in front of one side of the filter 60 and a second sidewall 273 disposed closer to the filter than the first sidewall 272. The first sidewall 272 protrudes farther downward than the second sidewall 273.

In the above structure, when water is sprayed from the cleaning nozzle 270 to remove lint from the filter 60, the water is directed in the direction parallel to the filter 60, and therefore, the water is prevented from falling in a fan shape, thereby maximizing cleaning force.

In the clothes dryer according to the above embodiments as described above, cleaning is automatically performed using condensed water absorbed from clothes without external supply of water. Also, water is stored in two water tanks, i.e., the recovery water tank 80; 280 and the cleaning water tank 90; 290, and a predetermined amount of water is stored in the cleaning water tank 90; 290, thereby maintaining cleaning ability.

In addition, the water tank filter 101; 301 to filter lint from water is mounted in the inlet 89; 289 of the recovery water tank 80; 280, and therefore, cleaning is performed using clean water from which the lint is removed.

The recovery water tank 80; 280 is separated from the cleaning water tank 90; 290, and therefore, a user may separate the recovery water tank 80; 280 from the cleaning water tank 90; 290 and discharge water from the recovery water tank 80; 280 to clean the water tank filter 101; 301.

As is apparent from the above description, the filter in the clothes dryer is efficiently cleaned without additional supply of water.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A clothes dryer comprising:

a main body;

a drum rotatably mounted in the main body to receive an object to be dried;

an air channel connected to the drum to supply air into the drum and to guide air discharged from the drum;

a dehumidification unit disposed in the air channel to condense moisture contained in the air discharged from the drum;

a waterspout to collect condensed water created by the dehumidification unit;

a filter to filter lint from the air discharged from the drum;

a cleaning nozzle to spray water to the filter to remove the lint from the filter;

a recovery water tank connected to the waterspout to receive water from the waterspout; and a cleaning water tank connected to the recovery water tank to receive water from the recovery water tank and to supply the water to the cleaning nozzle.

2. The clothes dryer according to claim 1, wherein the recovery water tank comprises a partition to divide an interior of the recovery water tank into a first storage chamber and a second storage chamber, and the partition comprises an opening through which the first storage chamber and the second storage chamber communicate with each other.

3. The clothes dryer according to claim 2, wherein the recovery water tank further comprises a connection port communicating with the cleaning water tank to allow water stored in the first storage chamber to be supplied to the cleaning water tank therethrough, and the connection port is located at a lower position than the opening of the partition.

4. The clothes dryer according to claim 3, wherein the recovery water tank further comprises a valve mounted in the connection port.

5. The clothes dryer according to claim 4, wherein the valve comprises a valve body to open and close the connection port and a spring to elastically bias the valve body such that the valve body closes the connection port, and the valve is automatically controlled by buoyancy of the water in the cleaning water tank and elastic force of the spring.

6. The clothes dryer according to claim 5, wherein the cleaning water tank comprises a rod having one end rotatably coupled to the cleaning water tank and a buoyant weight mounted to the other end of the rod, and the rod has a portion to push the valve body depending upon a position of the rod such that the connection port is opened, the portion of the rod being separated from the valve body such that the connection port is closed.

7. The clothes dryer according to claim 2, wherein the first storage chamber has a smaller storage capacity than the second storage chamber.

8. The clothes dryer according to claim 1, wherein the recovery water tank is detachably mounted to the cleaning water tank.

9. The clothes dryer according to claim 1, wherein the recovery water tank comprises an inlet to allow water from the waterspout to be introduced therethrough and a water tank filter disposed in the inlet to filter lint from the water.

10. The clothes dryer according to claim 1, wherein the cleaning water tank comprises a pump to pump water to the cleaning nozzle.

11. The clothes dryer according to claim 10, wherein the cleaning water tank is provided at a bottom thereof with a lower portion, which is lower than other portions, and the pump is mounted at the lower portion of the cleaning water tank.

12. The clothes dryer according to claim 10, wherein the cleaning nozzle comprises a nozzle inlet, a nozzle body, and a spray port, the nozzle body extends to opposite sides of the nozzle inlet such that the nozzle body is perpendicular to a direction in which water supplied through the nozzle inlet advances, and the spray port is provided at an end of the nozzle body in a slit shape.

13. The clothes dryer according to claim 12, wherein the nozzle body has an inner wall round at one side thereof, by which water is uniformly sprayed through the spray port.

14. The clothes dryer according to claim 10, further comprising a hose connected between the pump and the cleaning nozzle such that the hose is horizontally connected to the cleaning nozzle in front of the cleaning nozzle.

15. The clothes dryer according to claim 1, wherein the cleaning water tank comprises an outlet to allow water to be discharged therethrough and an opening and closing device to open and close the outlet.

16. The clothes dryer according to claim 15, wherein the opening and closing device comprises:

a valve arm rotatably mounted in the cleaning water tank, the valve arm being provided at one end thereof with an opening and closing part to open and close the outlet;

an arm spring to elastically bias the other end of the valve arm such that the outlet is closed by the opening and closing part; and a pushing unit to push the valve arm such that the outlet is opened by the opening and closing part.

17. The clothes dryer according to claim 15, wherein the cleaning nozzle comprises a nozzle inlet, a nozzle body, and a spray port, the nozzle body extends to one side of the nozzle inlet such that the nozzle body is perpendicular to a direction in which water supplied through the nozzle inlet advances, and the spray port is provided at an end of the nozzle body in a slit shape, the spray port having a width gradually increased as the spray port becomes distant from the nozzle inlet.

18. The clothes dryer according to claim 15, wherein the spray port of the cleaning nozzle comprises a first sidewall disposed in front of one side of the filter and a second sidewall disposed closer to the filter than the first sidewall, and the first sidewall protrudes farther downward than the second sidewall.

19. The clothes dryer according to claim 15, further comprising a hose connected between the outlet and the cleaning nozzle, the hose extending downward from the outlet to the cleaning nozzle such that water supplied to the cleaning nozzle via the hose flows to the cleaning nozzle.

20. The clothes dryer according to claim 1, wherein the humidification unit comprises an evaporator, a compressor, a condenser, and an expansion valve, and the evaporator generates the condensed water.

21. A clothes dryer comprising:

a main body;

a drum rotatably mounted in the main body to receive an object to be dried;

an air channel connected to the drum to supply air into the drum and to guide air discharged from the drum;

a filter mounted in the air channel to filter lint from the air;

a dehumidification unit disposed in the air channel to condense moisture contained in the air discharged from the drum;

a cleaning nozzle to spray water into the air channel to clean components mounted in the air channel;

a waterspout to collect condensed water created by the dehumidification unit;

a cleaning water tank to supply water to the cleaning nozzle; and a recovery water tank connected to the waterspout to receive water from the waterspout and to supply the water to the cleaning water tank, the recovery water tank being detachably mounted to the cleaning water tank.

22. The clothes dryer according to claim 21, wherein the recovery water tank comprises a partition to divide an interior of the recovery water tank into a first storage chamber and a second storage chamber, and the partition comprises an opening through which the first storage chamber and the second storage chamber communicate with each other.

23. The clothes dryer according to claim 22, wherein the recovery water tank further comprises a connection port communicating with the cleaning water tank to allow water stored in the first storage chamber to be supplied to the cleaning water tank therethrough, and the connection port is located at a lower position than the opening of the partition.

24. The clothes dryer according to claim 23, wherein the recovery water tank further comprises a valve mounted in the connection port.

25. The clothes dryer according to claim 24, wherein the valve comprises a valve body to open and close the connection port and a spring to elastically bias the valve body such that the valve body closes the connection port, and the valve is automatically controlled by buoyancy of the water in the cleaning water tank and elastic force of the spring.

26. The clothes dryer according to claim 25, wherein the cleaning water tank comprises a rod having one end rotatably coupled to the cleaning water tank and a buoyant weight mounted to the other end of the rod, and the rod has a portion to push the valve body depending upon a position of the rod such that the connection port is opened, the portion of the rod being separated from the valve body such that the connection port is closed.

27. The clothes dryer according to claim 22, wherein the first storage chamber has a smaller storage capacity than the second storage chamber.

28. The clothes dryer according to claim 21, wherein the cleaning water tank comprises a pump to pump water to the cleaning nozzle.

29. The clothes dryer according to claim 21, wherein the cleaning water tank comprises an outlet to allow water to be discharged therethrough and an opening and closing device to open and close the outlet.

30. A clothes dryer having a dehumidification unit to condense moisture contained in air drying an object to be dried while circulating in a main body and a filter mounted in front of the dehumidification unit to filter lint from the air, the clothes dryer comprising:

a cleaning water tank to store water to clean the filter;

a recovery water tank communicating with the cleaning water tank to supply water to the cleaning water tank;

a cleaning nozzle to spray the water received from the cleaning water tank to the filter; and a waterspout provided below the dehumidification unit and the filter to collect condensed water created by the dehumidification unit and the water sprayed from the cleaning nozzle and to supply water to the recovery water tank, wherein the recovery water tank comprises a water tank filter disposed in an inlet thereof to filter lint from the water supplied from the waterspout, and the recovery water tank is detachably mounted to the cleaning water tank.

31. The clothes dryer according to claim 30, wherein the cleaning water tank comprises a pump to pump water to the cleaning nozzle.

32. The clothes dryer according to claim 31, wherein the cleaning nozzle comprises a nozzle inlet, a nozzle body, and a spray port, the nozzle body extends to opposite sides of the nozzle inlet such that the nozzle body is perpendicular to a direction in which water supplied through the nozzle inlet advances, the spray port is provided at an end of the nozzle body in a slit shape, the nozzle body has an inner wall round at one side thereof, by which water is uniformly sprayed through the spray port, and the clothes dryer further comprises a hose connected between the pump and the cleaning nozzle such that the hose is horizontally connected to the cleaning nozzle in front of the cleaning nozzle.

* * * * *

UNITED STATES PATENT AND TRADEMARK OFFICE

CERTIFICATE OF CORRECTION

PATENT NO. : 8,615,895 B2
APPLICATION NO. : 12/932818
DATED : December 31, 2013
INVENTOR(S) : Chang Bong Shin et al.

It is certified that error appears in the above-identified patent and that said Letters Patent is hereby corrected as shown below:

Title page

Column 1, Item [30] (Foreign Application Priority Data), line 2, insert
-- July 22, 2010 (KR) ..... 10-2010-0071090 --

Signed and Sealed this
Thirteenth Day of October, 2015

Michelle K. Lee

Michelle K. Lee
*Director of the United States Patent and Trademark Office*